US009624857B2

(12) United States Patent
Sujan et al.

(10) Patent No.: US 9,624,857 B2
(45) **Date of Patent: *Apr. 18, 2017**

(54) SYSTEM AND METHOD OF DPF PASSIVE ENHANCEMENT THROUGH POWERTRAIN TORQUE-SPEED MANAGEMENT

(71) Applicant: CUMMINS INTELLECTUAL PROPERTY, INC., Minneapolis, MN (US)

(72) Inventors: Vivek A. Sujan, Columbus, IN (US); Timothy R. Frazier, Columbus, IN (US)

(73) Assignees: CUMMINS INTELLECTUAL PROPERTY, INC., Minneapolis, MN (US); PACCAR, INC., Bellevue, WA (US); EATON CORPORATION, Cleveland, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/919,123

(22) Filed: Oct. 21, 2015

(65) Prior Publication Data

US 2016/0040615 A1 Feb. 11, 2016

Related U.S. Application Data

(63) Continuation of application No. 13/407,583, filed on Feb. 28, 2012, now Pat. No. 9,194,318.
(Continued)

(51) Int. Cl.
*F01N 3/00* (2006.01)
*F02D 41/02* (2006.01)
(Continued)

(52) U.S. Cl.
CPC ..... *F02D 41/029* (2013.01); *F01N 3/0232* (2013.01); *F01N 9/002* (2013.01);
(Continued)

(58) Field of Classification Search
USPC ..... 60/274, 276, 280, 285, 286, 295, 297, 60/311
See application file for complete search history.

(56) References Cited

U.S. PATENT DOCUMENTS 4,368,509 A 1/1983 Li
5,231,897 A 8/1993 Morita
(Continued)

*Primary Examiner* — Binh Q Tran
(74) *Attorney, Agent, or Firm* — Foley & Lardner LLP

(57) ABSTRACT

This disclosure provides a method and system for determining recommendations for vehicle operation that reduce soot production in view of a diesel particulate filter (DPF) of an exhaust aftertreatment system. Recommendations generated can reduce excessive particulate matter (PM) production during transient engine events and provide for operating conditions favorable for passive regeneration. In this way, less frequent active regeneration of the DPF is needed and/or more opportunities are provided for passive regeneration. The system and method can utilize location and terrain information to anticipate and project a window of operation in view of reducing soot production and soot loading of the DPF, or provide the operator with instruction when such opportunities are present or will soon be encountered.

30 Claims, 3 Drawing Sheets

Related U.S. Application Data

(60) Provisional application No. 61/447,425, filed on Feb. 28, 2011.

(51) Int. Cl.

| | |
|---|---|
| ***F01N 3/023*** | (2006.01) |
| ***F01N 9/00*** | (2006.01) |
| *F01N 3/025* | (2006.01) |
| *F01N 3/035* | (2006.01) |

(52) U.S. Cl.
CPC ..... *F02D 41/021* (2013.01); *F01N 3/0253* (2013.01); *F01N 3/035* (2013.01); *F02D 2200/701* (2013.01)

(56) References Cited

U.S. PATENT DOCUMENTS

| | | | | |
|---|---|---|---|---|
| 5,394,331 | A | 2/1995 | Dudek et al. | |
| 5,598,335 | A | 1/1997 | You | |
| 6,038,505 | A | 3/2000 | Probst et al. | |
| 6,154,658 | A | 11/2000 | Caci | |
| 6,356,831 | B1 | 3/2002 | Michelini et al. | |
| 6,374,173 | B1 | 4/2002 | Ehlbeck | |
| 6,941,750 | B2 * | 9/2005 | Boretto | F01N 3/035 55/DIG. 30 |
| 7,036,305 | B2 | 5/2006 | Nishimura | |
| 7,155,334 | B1 | 12/2006 | Stewart et al. | |
| 7,469,533 | B2 | 12/2008 | Dawson et al. | |
| 7,591,130 | B2 * | 9/2009 | Ito | B60W 10/06 60/274 |
| 7,677,030 | B2 | 3/2010 | Dye et al. | |
| 7,742,867 | B2 | 6/2010 | Liu et al. | |
| 7,934,373 | B2 | 5/2011 | Chiba et al. | |
| 7,987,667 | B2 | 8/2011 | Meier et al. | |
| 8,079,212 | B2 | 12/2011 | Matsuoka et al. | |
| 8,392,091 | B2 | 3/2013 | Hebbale et al. | |
| 8,881,505 | B2 * | 11/2014 | Frazier | B60W 10/06 60/285 |
| 8,959,893 | B2 * | 2/2015 | Tajima | F02D 41/027 60/285 |
| 9,194,318 | B2 * | 11/2015 | Sujan | F02D 41/021 |
| 2003/0160455 | A1 | 8/2003 | Hu et al. | |
| 2004/0239488 | A1 | 12/2004 | Douglass et al. | |
| 2005/0090940 | A1 | 4/2005 | Pajakowski et al. | |
| 2005/0274553 | A1 | 12/2005 | Salman et al. | |
| 2006/0119507 | A1 | 6/2006 | Cawse | |
| 2006/0185626 | A1 | 8/2006 | Allen et al. | |
| 2007/0106442 | A1 | 5/2007 | Lu | |
| 2007/0112475 | A1 | 5/2007 | Koebler et al. | |
| 2008/0027639 | A1 | 1/2008 | Tryon | |
| 2008/0059036 | A1 | 3/2008 | Imai et al. | |
| 2008/0208393 | A1 | 8/2008 | Schricker | |
| 2008/0249667 | A1 | 10/2008 | Horvitz et al. | |
| 2008/0254937 | A1 | 10/2008 | Makiyama | |
| 2008/0262712 | A1 | 10/2008 | Duty et al. | |
| 2009/0082957 | A1 | 3/2009 | Agassi et al. | |
| 2009/0266060 | A1 | 10/2009 | Guo et al. | |
| 2009/0276267 | A1 | 11/2009 | Padan | |
| 2010/0010732 | A1 | 1/2010 | Hartman | |
| 2010/0023190 | A1 | 1/2010 | Kumar et al. | |
| 2010/0089041 | A1 | 4/2010 | Tai et al. | |
| 2010/0228404 | A1 | 9/2010 | Link et al. | |
| 2010/0287073 | A1 | 11/2010 | Kocis et al. | |

* cited by examiner

SYSTEM AND METHOD OF DPF PASSIVE ENHANCEMENT THROUGH POWERTRAIN TORQUE-SPEED MANAGEMENT

CROSS REFERENCE TO RELATED APPLICATIONS

This application is a continuation of U.S. patent application Ser. No. 13/407,583, filed on Feb. 28, 2012, which claims the benefit of priority to Provisional Patent Application No. 61/447,425 filed on Feb. 28, 2011, the entire contents of which are hereby incorporated by reference.

TECHNICAL FIELD

This disclosure relates to improved aftertreatment performance. More particularly, the present disclosure relates to optimizing vehicle engine and transmission operations to improve passive regeneration of the diesel particulate filter and reduce engine exhaust particulate matter.

BACKGROUND

Governments have been imposing progressive mandates for reducing amounts of particulate matter (PM) in exhaust emissions. The diesel particulate matter filter (DPF) has been developed for exhaust aftertreatment systems to remove diesel particulate matter containing soot, unburned fuel, lubrication oil etc. from the exhaust gas.

A DPF typically includes a filter encased in a canister that is positioned in the diesel exhaust stream. The filter is designed to collect PM while allowing exhaust gases to pass through it. Types of DPFs include ceramic and silicon carbide materials, fiber wound cartridges, knitted fiber silica coils, wire mesh and sintered metals. DPFs have demonstrated reductions in PM by up to 90% or more, and can be used together with a DOC to reduce HC, CO, and soluble organic fraction (SOF) of PM in diesel exhaust.

Because a DPF traps soot and other PM, it must be regenerated from time-to-time because the volume of PM generated by a diesel engine is sufficient to fill up and plug a DPF in a relatively short time. The regeneration process burns off or "oxidizes" PM that has accumulated in the filter. However, because diesel exhaust temperatures often are not sufficiently high to burn accumulated PM, various ways to raise the exhaust gas temperature or to lower the oxidation temperature are utilized. Regeneration can be accomplished passively by adding a catalyst to the filter. For example, a diesel oxidation catalyst (DOC) can be provided upstream of a DPF to oxidize NO to generate $NO_2$ (requiring accurate control to maintain the mass ratio of NO/PM in engine-out exhaust gas), which in turn oxidizes the PM in the downstream DPF. Alternatively, regeneration can be achieved actively by increasing the exhaust temperature through a variety of approaches, a fuel burner, resistive heating coils or late fuel injection.

However, running active DPF regeneration cycles involve injecting energy into the engine system and result in excess fuel use, and thus excess cost. Further, managing the soot load in the DPF in lean burning engine systems to reduce active cycling is difficult because operation of the engine system frequently involves soot producing transients. For instance, transients involving throttling increase fuel amounts in the air to fuel mixture such that the ratio can approach or exceed stoichiometric levels, resulting in excessive PM trapped by the DPF, and consequently requiring more active regeneration cycles.

SUMMARY

This disclosure provides a method and system for determining recommendations for powertrain operation that reduce soot production in connection with managing a diesel particulate filter (DPF) of an exhaust aftertreatment system. Recommendations generated reduce excessive particulate matter (PM) production during transient engine events and can provide operating conditions favorable for passive regeneration. In this way, less frequent active regeneration of the DPF is needed and/or more opportunities are provided for passive regeneration.

In one aspect of the disclosure, a method to enhance the passive regeneration of a DPF includes receiving current operating data indicative of a vehicle current operating state based on at least two of power demand, engine speed, engine torque, gear number, and vehicle speed; receiving terrain data indicative of terrain variation; determining a vehicle target operating state based on engine exhaust PM and engine transients; and providing an engine speed and transmission gear shift recommendation based on the vehicle target operating state to reduce at least one of the engine exhaust PM and the engine transients.

In another aspect of the disclosure, a system adapted to enhance the passive regeneration of a DPF includes a current operating state module including current operating state data indicative of a vehicle current operating state based on at least two of power demand, engine speed, engine torque, gear number, and vehicle speed; a terrain variation module including terrain data indicative of terrain variation; a target operating state module containing a vehicle target operating state based on engine exhaust PM and engine transients; and a recommendation module containing engine speed and transmission gear shift recommendations to reduce the engine exhaust PM and the engine transients.

DETAILED DESCRIPTION

Figure 1:
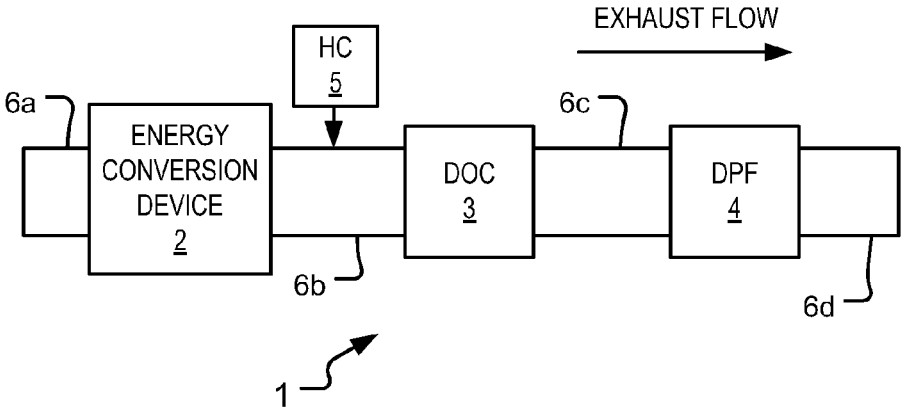
FIG. 1 is a diagram of an exhaust aftertreatment system fluidly coupled downstream of an energy conversion device.

FIG. 1 shows an exemplary exhaust aftertreatment system 1 fluidly coupled downstream of an energy conversion device 2, such as a turbine of a turbocharger. The exhaust aftertreatmnent system 1 includes a DOC 3 in the exhaust gas path downstream of the energy conversion device 2, a diesel particulate filter (DPI') 4 in the exhaust gas path downstream of the DOC 3. The elements of the energy conversion device 2 and the aftertreatment system 1 are fluidly connected via exhaust gas conduit sections **6*a*-6*d*. Additional elements can be included in the aftertreatment system I, such as an SCR (not shown) positioned downstream of the DOC 3 and DPF 4. A hydrocarbon (1-IC) doser 5 is provided in the exhaust gas conduit segment 6***b* between the energy conversion device 2 and the DOC 3 to inject fuel into the exhaust gas flow, for example, during an active regeneration cycle of the DPF 4. The soot load in the DPF 4 can be monitored using a delta-P soot load estimator (SLE), in which soot load estimation is determined based on pressure sensors measurement across the DPF. 4, or using a model-based SLE.

Due to the high cost of active regeneration of the DPF 4, opportunities to either enhance the passive regeneration capabilities or reduce the amount of exhaust particulate matter (PM) from the engine are of significant value. Further, opportunities to perform complete active regenerations are limited, which further increases the need for increased passive regeneration as well as the reduction of engine exhaust PM. The challenge is to optimally run an engine so as to maximize the passive regeneration of a DPF by managing both engine speed and engine transients through powertrain/driveline control, and in the longer run, use the strategy that is most efficient. For instance, a condition may exist in which less efficient operation of the engine (e.g., downshifting to a lower numbered gear to increase engine speed) is more economical because the additional fuel consumed by changing the operating state (i.e., downshifting) may be less than fuel consumed by a regeneration cycle of the DPF 4 otherwise required based on the SLE output if the current operating state is maintained. Thus, optimization of powertrain torque-speed management can include projecting required power for the vehicle operation over a period of time, a distance traveled, or operation window, and determining an optimal operating mode with consideration to fuel consumed by the operating mode and any required regeneration. This is especially useful in engine systems having access to positioning and terrain data, for example, using GPS and terrain/routing map data, and operation in cruise control mode, where required power in a the projected operating window can be readily and accurately estimated.

To optimize vehicle engine and transmission operations to improve passive regeneration of the DPF, applicants introduce a Cycle Efficiency Management (CEM) module. The CEM module employs control processes to furnish an operator with anticipated and currently desired vehicle operational behavior to optimize fuel economy. The CEM control processes focus on powertrain components such as engine, transmission, exhaust aftertreatment devices, accessories, final drive, wheels and vehicle. The processes can interface with the operator to provide guidance as to appropriate vehicle speed/power targets and transmission gear selection targets. The CEM module is useful in conditioning an operator to optimize behavior based on certain performance criteria.

Figure 2:
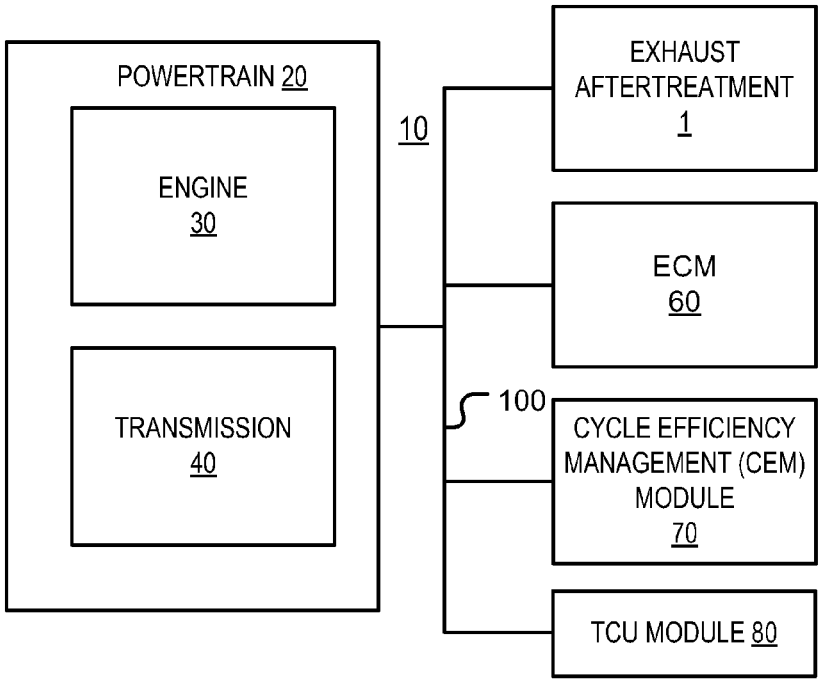
FIG. 2 is a diagram of an engine system according to an exemplary embodiment.

FIG. 2 shows a diagram of an exemplary engine system 10, which can be integrated into a vehicle (not shown), such as a truck or an automobile. Engine system 10 includes a powertrain system 20 including an internal combustion engine 30 and a transmission 40 of either a CVT or a discrete geared type. Also included in engine system 10 are the exhaust aftertreatment system 1 (including DPF 4), an engine control module (ECM) 60, a CEM module 70, and a transmission control unit (TCU) module 80. The components of engine system 10 communicate with ECM 60 and one another via a network system 100, which can be, for example, a controller area network (CAN). The engine system 10 can include a number of additional components not shown in FIG. 2.

Figure 3:
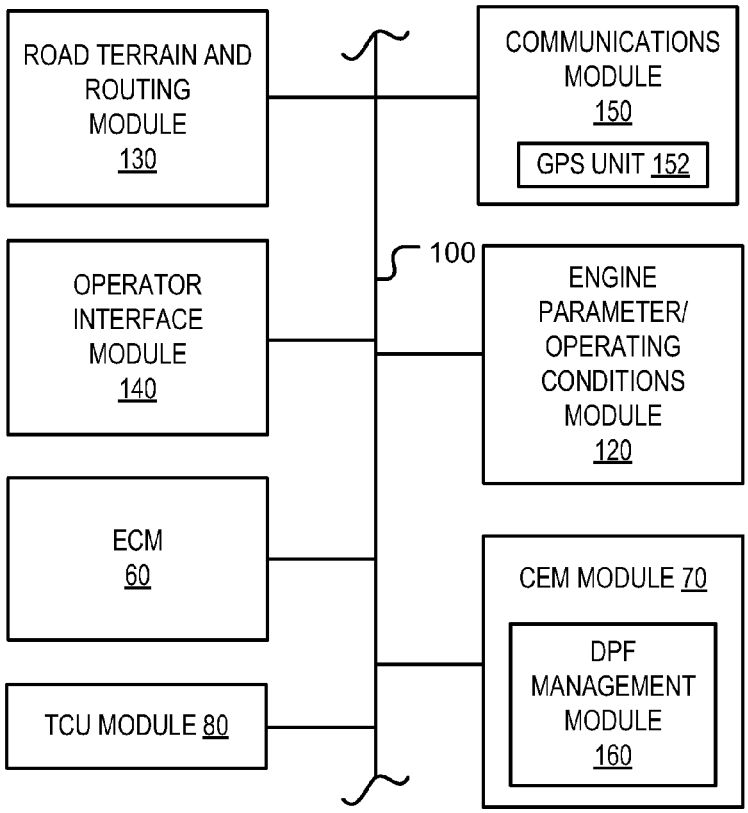
FIG. 3 is a diagram showing more details of control related modules present in exemplary engine system shown in FIG. 2.

FIG. 3 shows more details of control related modules that can be present in exemplary network system 100 of the engine system 10. Network system 100 includes the ECM 60, CEM module 70, and TCU module 80 shown in FIG. 1, and additional modules that communicate with ECM 60, CEM module 7, and/or TCU module 8 via network 10 (e.g., a CAN). It is to be appreciated that while modules in FIG. 3 are shown as separate, but communicatively coupled modules, all or some of these depicted modules can be grouped in any appropriate manner and/or combined to form one or more modules. For example, all depicted modules can be included with the ECM 60.

As shown in FIG. 3, the additional modules include an engine parameter/operating conditions module 120 configured to receive predetermined vehicle parameters and current vehicle operating conditions, a road terrain and routing module 130 configured to receive and/or store terrain profile data/information and routing information (destination/multi-destination routing), and an operator interface module 140 configured to receive operator input or other sourced input, and provide output from the CEM 70 to the operator. Any of the depicted modules can be configured to communicate with one another via communications module 150 (e.g., a CAN network module). A DPF management module 160 of the CEM module 70 determines a target operating state based on engine exhaust PM and engine transients. DPF management module 160 communicates with ECM 60 and TCU 80 to provide recommended operation that optimizes (typically minimizes) engine out PM through limiting engine transients.

Communications module 150 can include a GPS unit 152 to receive position data to determine coordinate positioning, and/or to supply data in advance of an operation or forthcoming positions or in real-time as the vehicle is operated and route traversed. Embodiments can provide for road terrain data to be maintained in computer storage and downloaded to CEM module 70 prior to the start of a trip or transmitted wirelessly over-the-air at any time, for example, by using cellular technology. The positioning information provided by GPS unit 152 can be used by operator interface module 140 and/or the road terrain and routing module 130 to determine where the vehicle is on a route, the current road conditions, and to predict future road conditions and related engine speed and fueling/torque requirements.

CEM module 70 can receive information from ECM 60, engine parameter/operating conditions module 120, the road terrain module 130, and/or the operator interface module 140 via communications module 150. The CEM 70 can include or have access to a data from a soot emission model (not shown) that can estimate an amount of soot that would be produced for a particular engine speed and torque. The soot emission model can be included, for example, in the ECM 60. This information can be used by DPF management module 160 to determine whether to recommend to ECM 60 an operating state that optimizes passive regeneration or minimizes soot production while still providing the required power. Further, the recommendation may consider other data, such as routing, projected time of delivery, and/or weather conditions, when determining an operation state to recommend. In an exemplary embodiment, engine transients are minimized by operating the engine in a range, or window of low speeds. Data such as routing, point of departure, destination, allowable travel time etc. can be provided by the operator via the operator interface module (e.g., via a touch screen, display, microphone or other interface device) or communicated to road terrain routing module 130 via communications module 150, for example.

Figure 4:
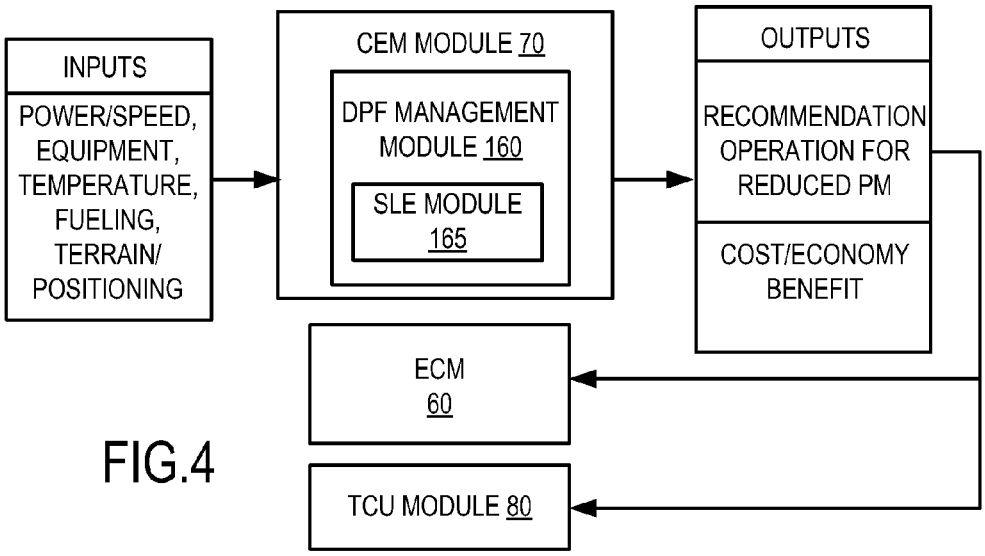
FIG. 4 is a diagram showing an example of a cycle efficiency management module along with exemplary inputs and generated outputs.

FIG. 4 shows a more detailed example of a CEM module 70 along with exemplary inputs and generated outputs. The inputs can include power demand, engine speed, engine temperature, engine torque, gear number (transmission type), vehicle speed fueling maps (hot and cold) and terrain/positioning information. CEM module 70 determines a recommendation, for example, containing engine speed and transmission gear shift recommendations to ECM 60 and TCU 80 that optimizes (typically minimizes) engine exhaust PM by limiting engine transients. This can be achieved with the aid of data available from GPS device 152, and/or an SLE module 165, which monitors and estimates soot loading (PM) in the DPF 4. The SLE module 165 can be provided elsewhere in network system 100, for example, in ECM 60, and communicate with DPF module 160 via network system 100. In this embodiment, data from GPS unit 152 indicating vehicle positioning and upcoming terrain variation is supplied to CEM module 70, which then can evaluate the terrain variation, the position of the vehicle in the terrain, and anticipates the engine load under various options and combinations of options.

For example, one option that can be considered by DPF management module 160 is translating all immediate upcoming terrain variation directly to engine load using the current transmission gear position, that is, without changing the gear state of the transmission 40.

Another option DPF management module 160 can consider includes considering engine load transients based on a +1/−1 (or similar) gear shift from the current transmission state or engine load transients with cylinder cutout. That is, the effects of an upshift to one or more higher transmission gears or downshift to one or more lower transmission gears can be considered for reducing transients of an upcoming event, or to change a current operating state to a more optimal state (e.g., lower speed) in view of DPF management.

Options for consideration by the DPF management module 160 include considerations made to place the engine 30 in a more oxygen-fuel concentration (OFC) conservative state in preparation for an upcoming transient, such as an increased load, and considerations made to place the future state of the engine 30 to reduce the transient from the current state (on a per cylinder basis).

The forgoing options and others, as well as their combinations, can be used to identify optimal engine-transmission relationships as a function of terrain variation. In an embodiment, these options can be considered with the state of soot loading in the DPF 4, for example, as estimated by the SLE module 165. For example, an amount of allowable soot production during a window of operation can be based in part on the amount of soot present in the DPF. Hence, when considering the available operating options, the allowable margins can change with estimated PM.

In addition to limiting engine transients to mitigate the generation of engine PM, the engine 30 and transmission 40 may also be managed to operate the engine 30 at lower speeds. By operating the engine 30 at lower speeds, passive regeneration opportunities continue to be available for the aftertreatment system to regenerate DPF 4. By shifting the transmission appropriately, the engine may be slowed down (or maintained in a specific speed window) based on current and future expected loads based on the terrain profile.

Additionally, the engine system 10 can maintain a balance between the engine 30 operating closer to its peak brake specific fuel consumption (BSFC), which may be achieved at a given engine speed by also cutting out cylinders as appropriate (i.e., cutting fuel, or fuel and air to one or more cylinders such that the remaining cylinders are operating closer to peak BSFC); the exhaust flow rate/temperature; and the ability to provide the desired transient response (such as sudden acceleration) in near future time events.

The engine speed also can be maintained at an overall lower value by shifting the engine governed-speed curve based on the need for more aggressive passive regeneration opportunities. Exemplary embodiments provide a benefit of increased freight efficiency in transporting cargo from source to destination. Inputs to process can also include engine fueling maps and engine braking/friction maps. Additional benefits include reduction of failed active DPF regeneration attempts and improvement in product life/warranty.

Both approaches—limiting engine transients and reducing engine speed—make use of an engine-transmission integrated system, where data in the form of GPS information can be used to supplement the decision making process to consider current and future terrain information. Without the GPS signal, optimal decisions would, in part, be based on the current engine state, throttle command, aftertreatment state and the transmission state. Although not all benefits would be realized, the non-GPS process could still coordinate activities with the transmission to minimize transients and maintain the engine at a relatively low overall operating speed.

In an exemplary embodiment, CEM module 70 performs supervisory DPF management of the engine system 10. In an exemplary embodiment, CEM module 70 can determine whether operator-controlled changes in engine speed and torque, for example, by down-shifting, no-shifting or up-shifting the transmission from its current gear and/or throttle adjustment to a condition favorable for reducing soot production or enhancing passive regeneration. By down-shifting the transmission upon entering an upgrade, for example, the engine can operate at a higher speed while producing the same amount of driveshaft power as with operation at lower speed, and can avoid the excess soot production that would otherwise be produces with increased throttling (fueling) at a lower engine speed. Thus, by generating recommendations for shifting the transmission up or down and/or increasing or decreasing the fueling rate via throttling adjustment, CEM module 70 can offer instruction to the operator during opportunities where more optimal engine out PM operation is possible. Generated recommendations can be indicated to the operator via a visible or audible interface (e.g., display, speaker, etc.).

Additionally, CEM module 70 can generate cost/economy benefit information for historical storage and/or display, for example, via operator interface module 140. This information can be provided as an instantaneous value, as a function development over a window (e.g., a look-ahead window), over an entire trip (source to destination), or to show benefit, cost savings, or performance of any other definable cumulative period.

Figure 5:
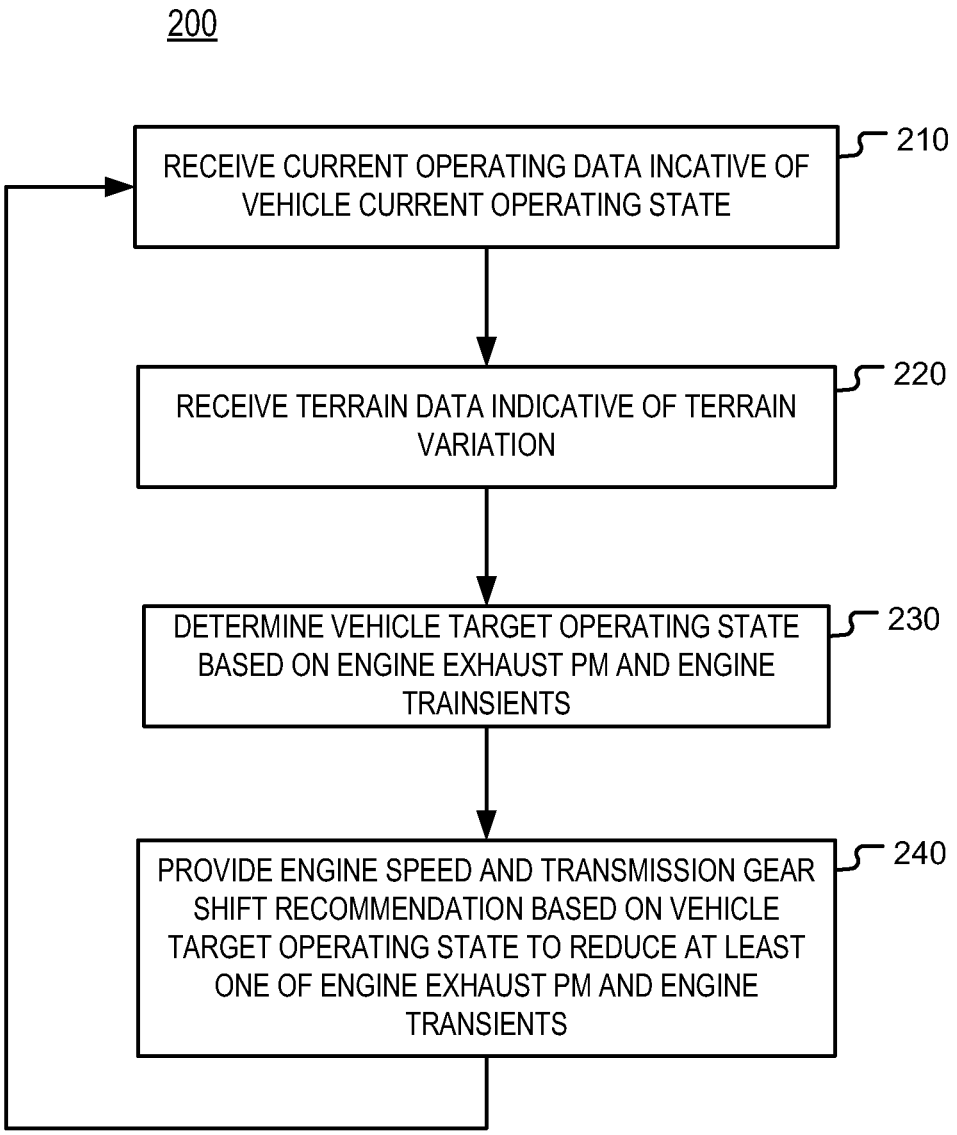
FIG. 5 is a process flow diagram of a method for enhancing passive regeneration of a DPF according to an exemplary embodiment.

FIG. 5 is a process flow diagram of an exemplary method 200 that enhances passive regeneration of a DPF. Starting in process 210, the method includes receiving data indicative of vehicle current operating state based on factors including, for example, power demand, engine speed and torque, gear number and vehicle speed. In process 220, data indicative of terrain variation is received. Next, in process 230, a vehicle target operating state is determined based on engine exhaust PM and engine transients. Process 240 provides an engine speed and transmission gear shift recommendation in view of reducing the engine exhaust PM and engine transients. The method can be restarted, for example, for another window of time or distance, when another transient condition is detected, as directed by the operator, or run continuously. Terrain variation can be based on current vehicle location or upcoming vehicle location.

Exemplary embodiments provide a system adapted to enhance the passive regeneration of a DPF. The system comprises a current operating state module including data indicative of vehicle current operating state based on at least two of power demand, engine speed, engine torque, gear number, and vehicle speed. The system further comprises terrain variation module including data indicative of terrain variation, a target operating state module containing a vehicle target operating state based on engine exhaust PM and engine transients, and a recommendation module containing engine speed and transmission gear shift recommendations in view of reducing said engine exhaust PM and engine transients.

Exemplary embodiments provide a system and method for optimizing vehicle engine and transmission operations to improve passive regeneration of the DPF and reduce engine exhaust PM to be implemented in computer programmable software and stored in tangible computer readable media. Such an embodiment would comprise a computer readable storage medium encoded with computer executable instructions, which when executed by a processor, perform the method for maximizing the passive regeneration of a DPF, as disclosed above.

Many aspects of this disclosure are described in terms of logic units or modules that include sequences of actions to be performed by elements of a control module and/or a network system, which can be a computer system or other hardware capable of executing programmed instructions. These elements can be embodied in a controller of an engine system, such as ECM 60, multiple controllers, or in a controller separate from, and communicating with the ECM 60 or distributed across several modules. In an embodiment, the ECM 60, CEM 70, and other depicted and described modules can be part of a CAN in which the controller, sensor, actuators communicate via digital CAN messages. It will be recognized that in embodiments consistent with the present disclosure, each of the various actions could be performed by specialized circuits (e.g., discrete logic gates interconnected to perform a specialized function), by program instructions, such as program modules, being executed by one or more processors (e.g., a central processing unit (CPU) or microprocessor), or by a combination of both, all of which can be implemented in a hardware and/or software of the ECM 60 and/or other controller, plural controllers, and/or modules, each of which can utilize a processor or share a processor with another unit (module, controller etc.) to perform actions required. For example, the engine parameter/operating conditions module 120 can be implemented as separate modules for the engine parameters and current operating conditions, and each module can be part of the ECM 60 or as a separately provided module. Logic of embodiments consistent with the disclosure can be implemented with any type of appropriate hardware and/or software, with portions residing in the form of computer readable storage medium with a control algorithm recorded thereon such as the executable logic and instructions disclosed herein, and can be programmed, for example, to include one or more singular or multi-dimensional engine and turbine look-up tables and/or calibration parameters. The computer readable medium comprise tangible forms of media, for example, a random access memory (RAM), a read-only memory (ROM), an erasable programmable read-only memory (e.g., EPROM, EEPROM, or Flash memory), an optical fiber, and a portable compact disc read-only memory (CD-ROM), or any other solid-state, magnetic, and/or optical disk medium capable of storing information. Thus, various aspects can be embodied in many different forms, and all such forms are contemplated to be consistent with this disclosure.

While various embodiments in accordance with the present disclosure have been shown and described herein, it is understood that the present disclosure is not limited these embodiments. Those skilled in the art will appreciate that other embodiments according to the present disclosure may include changes, modifications and further applications from embodiments described herein.

That which is claimed is:

1. A method to enhance the passive regeneration of a diesel particulate filter performed by an engine system having a processor and non-transitory computer-readable storage medium, the method comprising:

receiving, by the processor, current operating data indicative of a vehicle current operating state based on at least two of power demand, engine speed, engine torque, gear number, and vehicle speed;

receiving, by the processor, terrain data indicative of terrain variation;

determining, by the processor, a vehicle target operating state based on engine exhaust particulate matter and engine transients; and controlling, by the processor, engine speed and transmission gear selection based on the vehicle target operating state so as to reduce at least one of the engine exhaust particulate matter and the engine transients.

2. The method of claim 1, wherein the terrain variation is based on current vehicle location.

3. The method of claim 1, wherein the terrain variation is based on upcoming vehicle location.

4. The method of claim 1, wherein reducing the engine transients is determined on a per cylinder basis.

5. The method of claim 1, wherein the vehicle target operating state is determined based on an estimated exhaust particulate matter level present in the diesel particulate filter.

6. The method of claim 1, further comprising:

estimating, by the processor, a soot load relating to an amount of engine exhaust particulate matter in the diesel particulate filter, wherein the vehicle target operating state is determined based on the estimated soot load.

7. The method of claim 1, further comprising:

receiving, by the processor, positioning related data; and determining, by the processor, a position coordinate of a vehicle based on each of the position coordinate and the terrain data.

8. A system adapted to enhance the passive regeneration. of a diesel particulate filter, comprising:

an engine system; and a controller operatively coupled to the engine system, the controller having a processor and non-transitory computer-readable storage medium, the controller including:

a current operating state circuit including current operating state data indicative of a vehicle current operating state based on at least two of power demand, engine speed, engine torque, gear number, and vehicle speed;

a terrain variation circuit including terrain data indicative of terrain variation;

a target operating state circuit structured to determine a vehicle target operating state based on engine exhaust particulate matter and engine transients; and an engine control circuit structured to control engine speed based on the determined vehicle target operating state so as to reduce the engine exhaust particulate matter and the engine transients.

9. The system of claim 8, wherein the controller further includes transmission control circuit structured to control transmission gear selection based on the determined vehicle target operating state so as to reduce the engine exhaust particulate matter and the engine transients.

10. The system of claim 8, wherein the controller further includes a soot load estimate circuit structured to estimate an amount of engine exhaust particulate matter in the diesel particulate filter, wherein the target operating state circuit is structured to determine the vehicle target operating state further based on the estimate.

11. The system of claim 8, wherein the controller further includes a position coordinate determining circuit structured to receive data related to positioning and determine a vehicle position based on each of the positioning data and the terrain data.

12. A method to enhance the passive regeneration of a diesel particulate filter performed by an engine system having a processor and non-transitory computer-readable storage medium, the method comprising:

receiving, by the processor, current operating data indicative of a vehicle current operating state;

determining, by the processor, a vehicle target operating state based on the vehicle current operating state so as to minimize fuel consumption by each of the engine system and active regeneration anticipated to be required by operation in the vehicle target operating state; and providing, by the processor, an engine speed and transmission gear shift recommendation based on the vehicle target operating state.

13. The method of claim 12, wherein the current operating data includes at least two of power demand, engine speed, engine torque, gear number, and vehicle speed.

14. The method of claim 13, wherein the current operating data further includes terrain data indicative of vehicle terrain.

15. The method of claim 12, wherein the fuel consumption is determined based on an estimated power required for the vehicle target operating state for at least one of a period of time, a distance traveled, and an operation window.

16. The method of claim 15, wherein the fuel consumption is determined further based on predicted future road conditions and at least one of corresponding engine speed, torque, and fueling requirements.

17. A system adapted to enhance the passive regeneration of a diesel particulate filter, comprising:

an engine system; and a controller operatively coupled to the engine system, the controller having a processor and non-transitory a computer-readable storage medium, the controller including:

a current operating state circuit including current operating state data indicative of a vehicle current operating state;

a target operating state circuit structured to determine a vehicle target operating state so as to minimize fuel consumption by each of the engine system and active regeneration anticipated to be required by operation in the vehicle target operating state; and a recommendation circuit structured to provide engine speed and transmission gear shift recommendations based on the vehicle target operating state.

18. The system of claim 17, wherein the current operating data includes at least two of power demand, engine speed, engine torque, gear number, and vehicle speed.

19. The system of claim 17, wherein the controller further includes a terrain variation circuit including terrain data indicative of terrain variation, wherein the vehicle current operating state is based at least in part on the terrain data.

20. The system of claim 17, wherein the fuel consumption is determined based on an estimated power required for the vehicle target operating state for at least one of a period of time, a distance traveled, and an operation window.

21. The system of claim 20, wherein the fuel consumption is determined further based on predicted future road conditions and at least one of corresponding engine speed, torque, and fueling requirements.

22. A method to enhance the passive regeneration of a diesel particulate filter performed by an engine system having a processor and non-transitory computer-readable storage medium, the method comprising:

receiving, by the processor, current operating data indicative of a vehicle current operating state;

determining, by the processor, a vehicle target operating state based on the vehicle current operating state so as to minimize fuel consumption by each of the engine system and active regeneration anticipated to be required by operation in the vehicle target operating state; and controlling, by the processor, engine speed and transmission gear selection based on the vehicle target operating state, wherein the current operating data further includes terrain data indicative of vehicle terrain.

23. The method of claim 22, wherein the current operating data includes at least two of power demand, engine speed, engine torque, gear number, and vehicle speed.

24. The method of claim 22, wherein the fuel consumption is determined based on an estimated power required for the vehicle target operating state for at least one of a period of time, a distance traveled, and an operation window.

25. The method of claim 24, wherein the fuel consumption is determined further based on predicted future road conditions and at least one of corresponding engine speed, torque, and fueling requirements.

26. ently Amended) A system adapted to enhance the passive regeneration of a diesel particulate filter, comprising:

an engine system; and a controller operatively coupled to the engine system, the controller having a processor and non-transitory a computer-readable storage medium, the controller including:

a current operating state circuit including current operating state data indicative of a vehicle current operating state;

a target operating state circuit structured to determine a vehicle target operating state so as to minimize fuel consumption by each of the engine system and active regeneration anticipated to be required by operation in the vehicle target operating state;

an engine control circuit structured to control engine speed based on the vehicle target operating state, and a terrain variation circuit including terrain data indicative of terrain variation, wherein the vehicle current operating state is based at least in part on the terrain data.

27. The system of claim 26, wherein the controller further includes a transmission control circuit structured to control transmission gear selection based on the determined vehicle target operating state.

28. The system of claim 26, wherein the current operating data includes at least two of power demand, engine speed, engine torque, gear number, and vehicle speed.

29. The system of claim 26, wherein the fuel consumption is determined based on an estimated power required for the vehicle target operating state for at least one of a period of time, a distance traveled, and an operation window.

30. The system of claim 26, wherein the fuel consumption is determined further based on predicted future road conditions and at least one of corresponding engine speed, torque, and fueling requirements.

* * * * *